US008033125B2

(12) United States Patent
Saruwatari et al.

(10) Patent No.: US 8,033,125 B2
(45) Date of Patent: Oct. 11, 2011

(54) AIR CONDITIONER CONTROL DEVICE

(75) Inventors: Hirotaka Saruwatari, Sakai (JP); Hiroyuki Matsuura, Sakai (JP); Mario Hayashi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 481 days.

(21) Appl. No.: 12/306,757

(22) PCT Filed: Jul. 4, 2007

(86) PCT No.: PCT/JP2007/063339

§ 371 (c)(1),
(2), (4) Date: Dec. 29, 2008

(87) PCT Pub. No.: WO2008/007586

PCT Pub. Date: Jan. 17, 2008

(65) Prior Publication Data

US 2009/0320507 A1 Dec. 31, 2009

(30) Foreign Application Priority Data

Jul. 10, 2006 (JP) ..... 2006-188964

(51) Int. Cl.

| | |
|---|---|
| ***G05D 23/32*** | (2006.01) |
| ***F25D 21/06*** | (2006.01) |
| ***G01M 1/38*** | (2006.01) |
| ***G06F 11/00*** | (2006.01) |

(52) U.S. Cl. ..... 62/157; 62/155; 700/276; 714/10; 714/15

(58) Field of Classification Search ..... 62/234, 62/155, 156, 157; 700/275, 276; 714/2, 714/10, 15, 18

See application file for complete search history.

(56) References Cited

FOREIGN PATENT DOCUMENTS

| | | | |
|---|---|---|---|
| JP | 55-134256 | A | 10/1980 |
| JP | 60-50351 | A | 3/1985 |
| JP | 04-052466 | A | 2/1992 |
| JP | 05-196329 | A | 8/1993 |
| JP | 06-221734 | A | 8/1994 |
| JP | 08-083386 | A | 3/1996 |
| JP | 10-141743 | A | 5/1998 |
| JP | 11-132578 | A | 5/1999 |
| JP | 2000-220833 | A | 8/2000 |
| JP | 2001-004217 | A | 1/2001 |
| JP | 2001-108288 | A | 4/2001 |
| JP | 2002-115920 | A | 4/2002 |
| JP | 2002-320284 | A | 10/2002 |
| JP | 2004-156829 | A | 6/2004 |
| JP | 2004-301436 | A | 10/2004 |
| JP | 2004-309073 | A | 11/2004 |

*Primary Examiner* — Chen Wen Jiang
(74) *Attorney, Agent, or Firm* — Global IP Counselors

(57) ABSTRACT

A control device includes a microcomputer and a storage element. The microcomputer is configured to execute an inspection operation mode in which an air conditioner is operated in inspection process in a manufacturing site, and a normal operation mode in which the air conditioner is operated at an installation site. When the operation state of the air conditioner fails to satisfy predetermined conditions, the microcomputer is configured to confirm that there is an error, and abnormally stop the air conditioner. When the air conditioner is abnormally stopped, the microcomputer is configured to cause the storage element to store predetermined operation information obtained during a period until abnormal stoppage of the air conditioner and to store the operation mode being executed at the time of occurrence of the error in the air conditioner.

12 Claims, 5 Drawing Sheets

AIR CONDITIONER CONTROL DEVICE

CROSS-REFERENCE TO RELATED APPLICATIONS

This U.S. National stage application claims priority under 35 U.S.C. §119(a) to Japanese Patent Application No. 2006-188964, filed in Japan on Jul. 10, 2006, the entire contents of which are hereby incorporated herein by reference.

TECHNICAL FIELD

The present invention relates to a control device of an air conditioner.

BACKGROUND ART

A conventional air conditioner control device employs a method in which operation information at the time of occurrence of an error is stored in a memory in order to simplify factor analysis when an error occurs in the air conditioner (for example, see JP-A Publication No. 2004-156829).

SUMMARY OF THE INVENTION DISCLOSURE OF THE INVENTION

Object to be Achieved by the Invention

The method described in JP-A Publication No. 2004-156829 has simplified the process of extracting multiple error factors and produced certain effects. However, the process of narrowing multiple error factors down to key factors is still complicated even today.

An object of the present invention is to provide an air conditioner control device capable of simplifying the narrowing down of error factors in case of occurrence of an error in an air conditioner.

Means to Achieve the Object

An air conditioner control device according to a first aspect of the present invention includes a microcomputer and a storage element (memory). The microcomputer executes an inspection operation mode in which the air conditioner is operated in an inspection process in a manufacturing site, and a normal operation mode in which the air conditioner is operated at an installation site. When the operation state of the air conditioner fails to satisfy predetermined conditions, the microcomputer confirms that there is an error, and abnormally stops the air conditioner. The memory stores specific information by a command from the microcomputer. Then, when abnormally stopping the air conditioner, the microcomputer causes the memory to store specific operation information obtained during a period until abnormal stoppage of the air conditioner and the operation mode being executed at the time of occurrence of the error in the air conditioner.

In this air conditioner control device, the backgrounds at the time of occurrence of an error, i.e., whether the error occurred during inspection or during normal operation, and the like, become clear. This simplifies the narrowing down of error factors.

An air conditioner control device according to a second aspect of the present invention is the air conditioner control device according to the first aspect of the present invention, wherein the normal operation mode includes a plurality of control modes. When abnormally stopping the air conditioner, the microcomputer causes the memory to store the control mode being executed at the time of occurrence of an error in the air conditioner.

In this air conditioner control device, the control mode being executed is identified and thereby an error that can occur only in the identified control mode is specified. Alternatively, an error that would not occur in the identified control mode is excluded from the subject of analysis of error factors. This simplifies the narrowing down of error factors.

An air conditioner control device according to a third aspect of the present invention is the air conditioner control device according to the second aspect of the present invention, wherein the plurality of control modes include an off-time control mode in which the air conditioner is controlled while an compressor is stopped. Note that the air conditioner includes a refrigerant circuit having the compressor.

This air conditioner control device simplifies the narrowing down of error factors with respect to an error that occurred during off-time control.

An air conditioner control device according to a fourth aspect of the present invention is the air conditioner control device according to the second aspect of the present invention, wherein the plurality of control modes include a pre-activation pressure equalization control mode in which a difference in pressure between a high pressure side and a low pressure side in a refrigerant circuit is eliminated before the compressor is activated. Note that the air conditioner includes the refrigerant circuit having the compressor.

This air conditioner control device simplifies the narrowing down of error factors with respect to an error that occurred during pre-activation pressure equalization control.

An air conditioner control device according to a fifth aspect of the present invention is the air conditioner control device according to the second aspect of the present invention, wherein the plurality of control modes include an activation control mode in which a compressor is activated. Note that the air conditioner includes a refrigerant circuit having the compressor.

This air conditioner control device simplifies the narrowing down of error factors with respect to an error that occurred during activation control.

An air conditioner control device according to a sixth aspect of the present invention is the air conditioner control device according to the second aspect of the present invention, wherein the plurality of control modes include a test operation control mode in which test operation after installation of the air conditioner is performed.

This air conditioner control device simplifies the narrowing down of error factors with respect to an error that occurred during test operation control.

An air conditioner control device according to a seventh aspect of the present invention is the air conditioner control device according to the second aspect of the present invention, wherein the plurality of control modes include a stationary control mode in which stationary operation of the air conditioner is performed after a compressor is activated. Note that the air conditioner includes a refrigerant circuit having the compressor.

This air conditioner control device simplifies the narrowing down of error factors with respect to an error that occurred during stationary control.

An air conditioner control device according to an eighth aspect of the present invention is the air conditioner control device according to the second aspect of the present invention, wherein the plurality of control modes include an oil return control mode in which refrigerating machine oil accumulated in a refrigerant circuit is forcibly returned to a compressor. Note that the air conditioner includes the refrigerant circuit having the compressor.

In this air conditioner control device, with respect to an error that occurred during oil return control, an error that would not occur in the oil return control mode is excluded from the subject of analysis of error factors, which thus simplifies the narrowing down of error factors.

An air conditioner control device according to a ninth aspect of the present invention is the air conditioner control device according to the second aspect of the present invention, wherein the plurality of control modes include a pump down control mode in which liquid refrigerant in a refrigerant circuit is accumulated in a specific container when the operation of the air conditioner is stopped. Note that the air conditioner includes the refrigerant circuit having the compressor.

In this air conditioner control device, with respect to an error that occurred during pump down control, an error that would not occur in the pump down control mode is excluded from the subject of analysis of error factors, which thus simplifies the narrowing down of error factors.

An air conditioner control device according to a tenth aspect of the present invention is the air conditioner control device according to the second aspect of the present invention, wherein the plurality of control modes include a defrost control mode in which defrosting is performed when frost is formed during heating operation of the air conditioner.

In this air conditioner control device, with respect to an error that occurred during defrost control, an error that would not occur in the defrost control mode is excluded from the subject of analysis of error factors, which thus simplifies the narrowing down of error factors.

An air conditioner control device according to an eleventh aspect of the present invention is the air conditioner control device according to the second aspect of the present invention, wherein the plurality of control modes include a post-defrost control mode in which control after completion of defrosting is performed during heating operation of the air conditioner.

In this air conditioner control device, with respect to an error that occurred during post-defrost control, an error that would not occur in the post-defrost control mode is excluded from the subject of analysis of error factors, which thus simplifies the narrowing down of error factors.

An air conditioner control device according to a twelfth aspect of the present invention is the air conditioner control device according to the first aspect of the present invention, wherein the microcomputer causes a signal to be transmitted and received between an outdoor side of the air conditioner and an indoor side of the air conditioner, and switches between the inspection operation mode and the normal operation mode based on source information being sent from the indoor side which reveals what equipment is connected on the indoor side.

In this air conditioner control device, whether an error occurred during inspection or during normal operation becomes clear. When the error occurred in the air conditioner during the inspection operation mode, such situation can be recreated in the inspection process, which thus simplifies the narrowing down of error factors.

EFFECTS OF THE INVENTION

In the air conditioner control device according to the first aspect of the present invention, the backgrounds at the time of occurrence of an error, i.e., whether the error occurred during inspection or during normal operation, and the like, become clear. This simplifies the narrowing down of error factors.

In the air conditioner control device according to the second aspect of the present invention, the control mode being executed is identified and thereby an error that can occur only in the identified control mode is specified. Alternatively, an error that would not occur in the identified control mode is excluded from the subject of analysis of error factors. This simplifies the narrowing down of error factors.

In the air conditioner control device according to the third through seventh aspects of the present invention, narrowing down of error factors is simplified with respect to an error that occurred during specific control.

In the air conditioner control device according to the eighth through eleventh aspects of the present invention, with respect to an error that occurred during specific control, an error that would not occur in the specific control mode is excluded from the subject of analysis of error factors, which thus simplifies the narrowing down of error factors.

In the air conditioner control device according to the twelfth aspect of the present invention, when the error occurred in the air conditioner during the inspection operation mode, such situation can be recreated in the inspection process, which thus simplifies the narrowing down of error factors.

DETAILED DESCRIPTION OF THE INVENTION

<Structure of the Air Conditioner>

Figure 1:
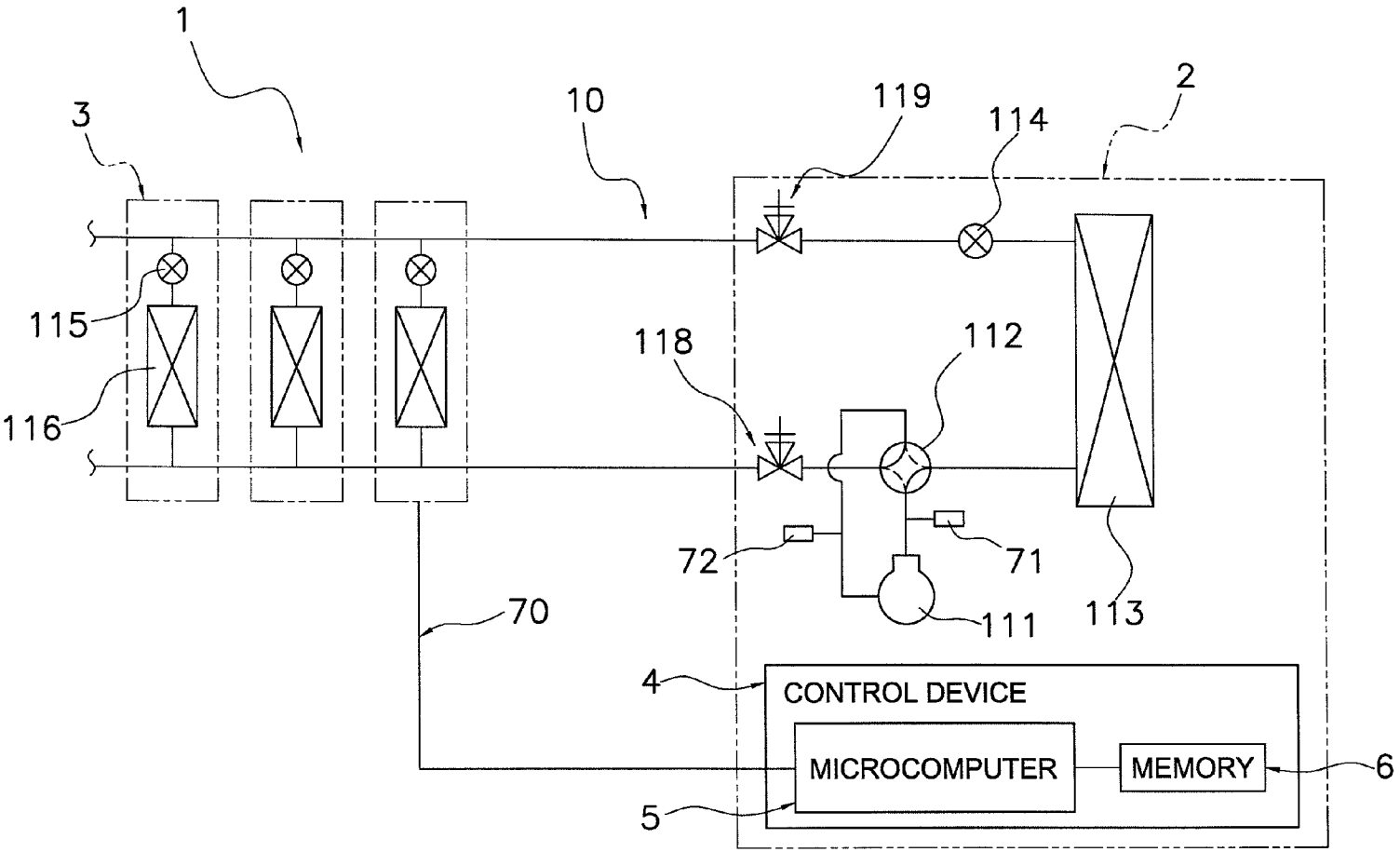
FIG. 1 is a configuration diagram of an air conditioner.

FIG. 1 is a configuration diagram of an air conditioner. An air conditioner 1 is a multi-type air conditioner for a building, in which a plurality of air conditioner indoor units 3 are connected in parallel to one or a plurality of air conditioner outdoor units 2, and a refrigerant circuit 10 is formed by the interconnection of devices such as a compressor 111, a four way valve 112, an outdoor heat exchanger 113, an outdoor expansion valve 114, an indoor expansion valve 115, an indoor heat exchanger 116, a gas shut-off valve 118, and a liquid shut-off valve 119 such that the refrigerant can circulate therethrough.

A control device 4 is equipped with a microcomputer 5 and a storage element (memory) 6. The microcomputer 5 causes a signal to be transmitted and received (hereinafter referred to as "in-and-out transmission") between the air conditioner outdoor unit 2 and the air conditioner indoor unit 3 via an in-and-out transmission line 50, and causes the memory 6 to store necessary information.

<Operation Mode>

Figure 2:
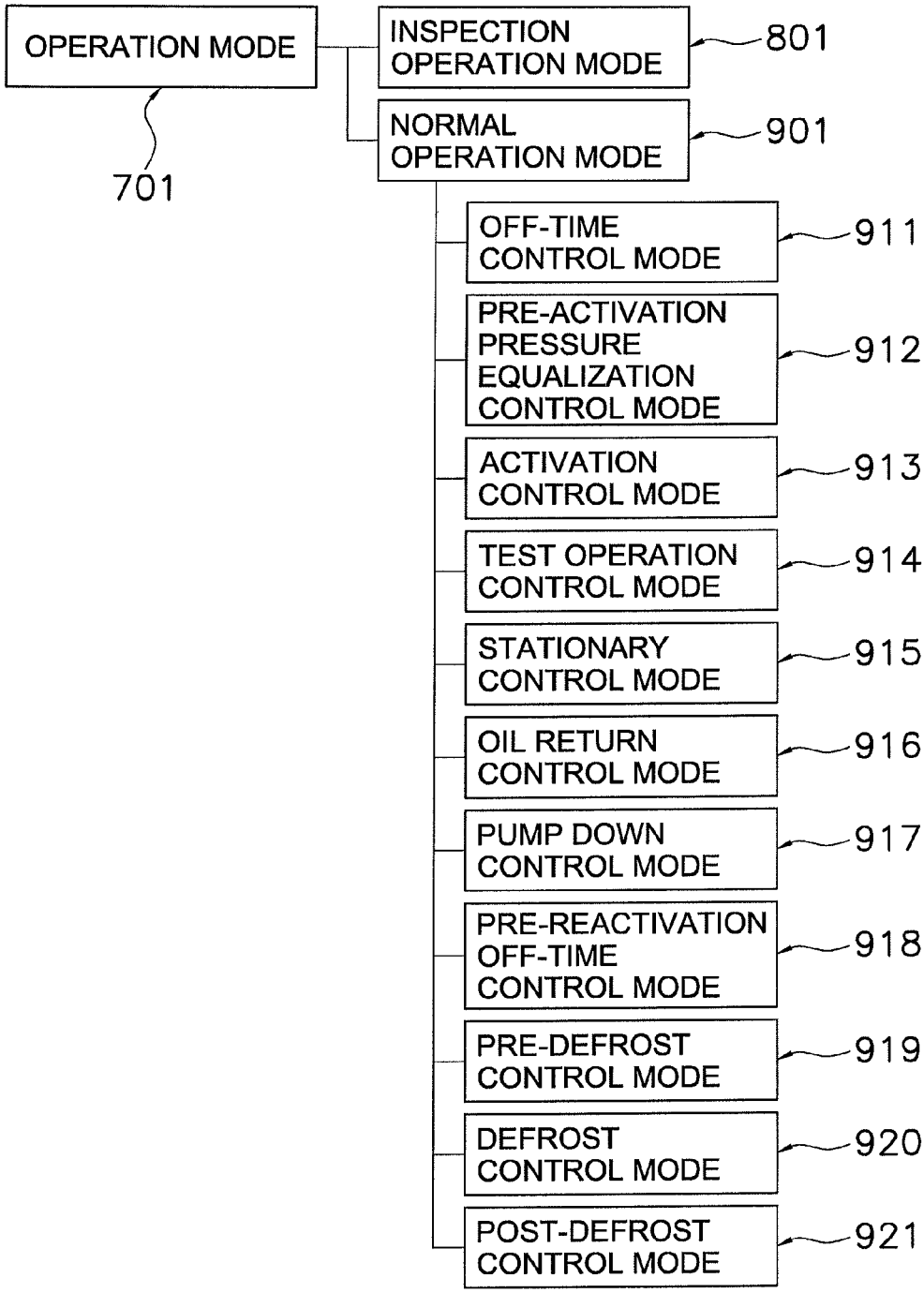
FIG. 2 is a configuration diagram of an operation mode of the air conditioner.

FIG. 2 is a configuration diagram of an operation mode of the air conditioner. An operation mode 701 of the air conditioner 1 is classified into an inspection operation mode and a normal operation mode. The inspection operation mode is a mode in which the air conditioner 1 is operated in an inspection process in a manufacturing site, and is hereinafter referred to as an inspection operation mode 801. The normal operation mode is a mode in which the air conditioner is normally operated at an installation site, and is hereinafter referred to as a normal operation mode 901.

(Inspection Operation Mode)

The microcomputer 5 causes the in-and-out transmission between the air conditioner outdoor unit 2 and the air conditioner indoor unit 3 via the in-and-out transmission line 50. Note that, in the inspection process at a manufacturing site, inspection equipment (not shown) instead of the air conditioner indoor unit 3 is connected to the in-and-out transmission line 50. Consequently, the microcomputer 5 recognizes that the inspection equipment is connected based on the source information that is sent from the inspection equipment, and sets the operation mode 701 to the inspection operation mode 801.

Therefore, when an error is detected during execution of the inspection operation mode 801, the microcomputer 5 causes the memory 6 to store the fact that the operation mode 701 at the time of occurrence of the error is the inspection operation mode 801. When analyzing error factors at a later date, whether the error occurred in the inspection process at a manufacturing site or occurred at an installation site will be identified, simplifying the analytical work. In particular, in the case of an error that occurred in the inspection process, the error can be easily recreated, which thus simplifies the narrowing down of error factors.

(Normal Operation Mode)

On the other hand, the microcomputer 5 sets the operation mode 701 to the normal operation mode 901 when recognizing that the air conditioner indoor unit 3 is connected. The normal operation mode 901 includes a plurality of control modes 911 to 921.

The off-time control mode 911 is control that is executed while the compressor 111 is stopped. The pre-activation pressure equalization control mode 912 is control to eliminate a difference in pressure between the high pressure side and the low pressure side of the refrigerant circuit 10 before the compressor 111 is activated in order to improve activation performance.

The activation control mode 913 is control to activate the compressor 111. The test operation control mode 914 is control to perform operation check after the air conditioner 1 is installed. The stationary control mode 915 is control to run the air conditioner 1 in stationary operation.

The oil return control mode 916 is control to forcibly collect refrigerating machine oil accumulated in the refrigerant circuit 10 to the compressor 111 after cooling operation, heating operation, or the like is performed for a certain period of time.

The pump down control mode 917 is control to store liquid refrigerant in a container when the operation is stopped such that gas refrigerant on the low pressure side of the compressor 111 stays dry. The pump down control mode 917 prevents the liquid-back phenomenon at the time of reactivation of the compressor 111.

The pre-reactivation off-time control mode 918 is control that is executed while the compressor 111 is stopped in the standby state.

The pre-defrost control mode 919 is control that is executed prior to the defrost control mode 920. The post-defrost control mode 921 is control that is executed after the defrost control mode 920 is finished. Note that the defrost control is control to defrost the outdoor heat exchanger 113 that is frosted during heating operation of the air conditioner 1.

<Operation Mode Selection Control>

Figure 3:
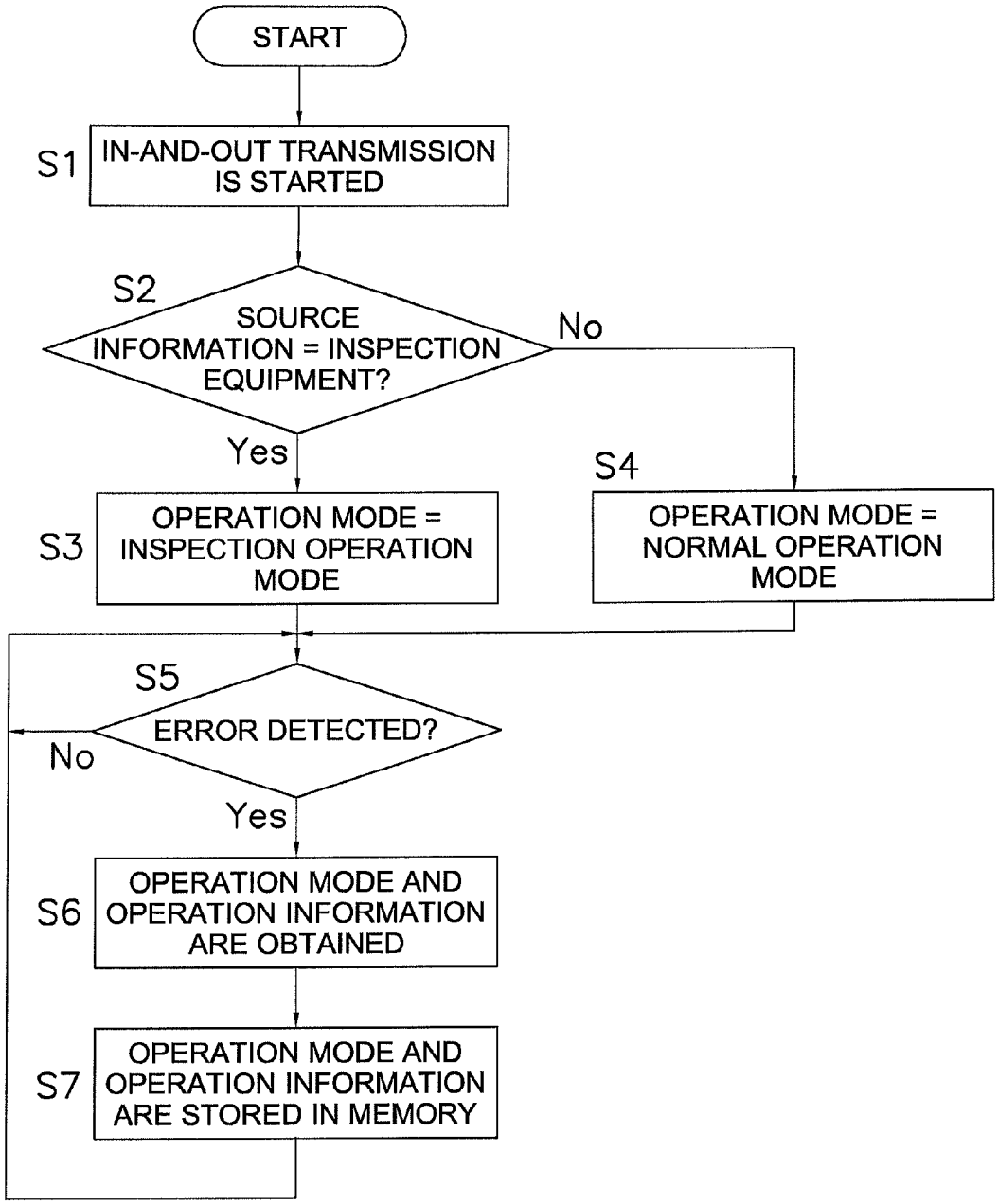
FIG. 3 is a flowchart of operation mode selection and control.

FIG. 3 is a flowchart of operation mode selection and control. The microcomputer 5 starts the in-and-out transmission in step S1. The equipment connected to the in-and-out transmission line 50 is usually the air conditioner indoor unit 3: however, in the inspection process at a manufacturing site, inspection equipment is connected to the in-and-out transmission line 50. Consequently, when the in-and-out transmission is started, the source information starts to be sent which reveals what equipment is connected to the in-and-out transmission line 50. In step S2, a judgment is made whether the source information is from the inspection equipment or not.

When it is judged in step S2 that it is from the inspection equipment, the flow proceeds to step S3 where the inspection operation mode 801 is selected as the operation mode 701. On the other hand, when it is judged "No" in step S2, it means that the air conditioner indoor unit 3 is connected, and thus the flow proceeds to step S4 where the normal operation mode 901 is selected as the operation mode 701.

In step S5, the microcomputer 5 judges the presence of an error. When there is an error, the operation mode being executed at the time of occurrence of the error and the operation information such as the details of the error are obtained in step S6. In step S7, the operation mode and the operation information obtained in step S6 are stored in the memory 6.

<Narrowing Down of the Error Factors by the Operation Mode>

Here, the process to narrow down error factors from the operation mode at the time of occurrence of an error and the operation information is described.

(Error Confirmation Control for the Low Pressure Error)

In order to prevent seizure of the compressor 111 caused by a rise in the internal temperature thereof due to an abnormal drop in low pressure side pressure as a result of factors such as shut-off valves 118 and 119 being left closed, extreme gas shortage, and the like, the microcomputer 5 executes control to abnormally stop the compressor 111 when the low pressure side pressure drops. This is referred to as error confirmation control for the low pressure error. On the other hand, in order to prevent abnormal stoppage caused by a transient drop in the low pressure side pressure, low pressure standby control is also executed in which the compressor 111 is forcibly stopped before an error occurs so as to determine whether or not the drop is transient. The number of times in which the compressor 111 is brought to the low pressure standby state is counted by a low pressure standby counter (not shown). When the compressor 111 is brought to the low pressure standby state a predetermined number of times, it means that the low pressure error is present. Note that although there are several conditions that bring the compressor 111 to the low pressure standby state, only some of the conditions are cited herein.

Figure 4:
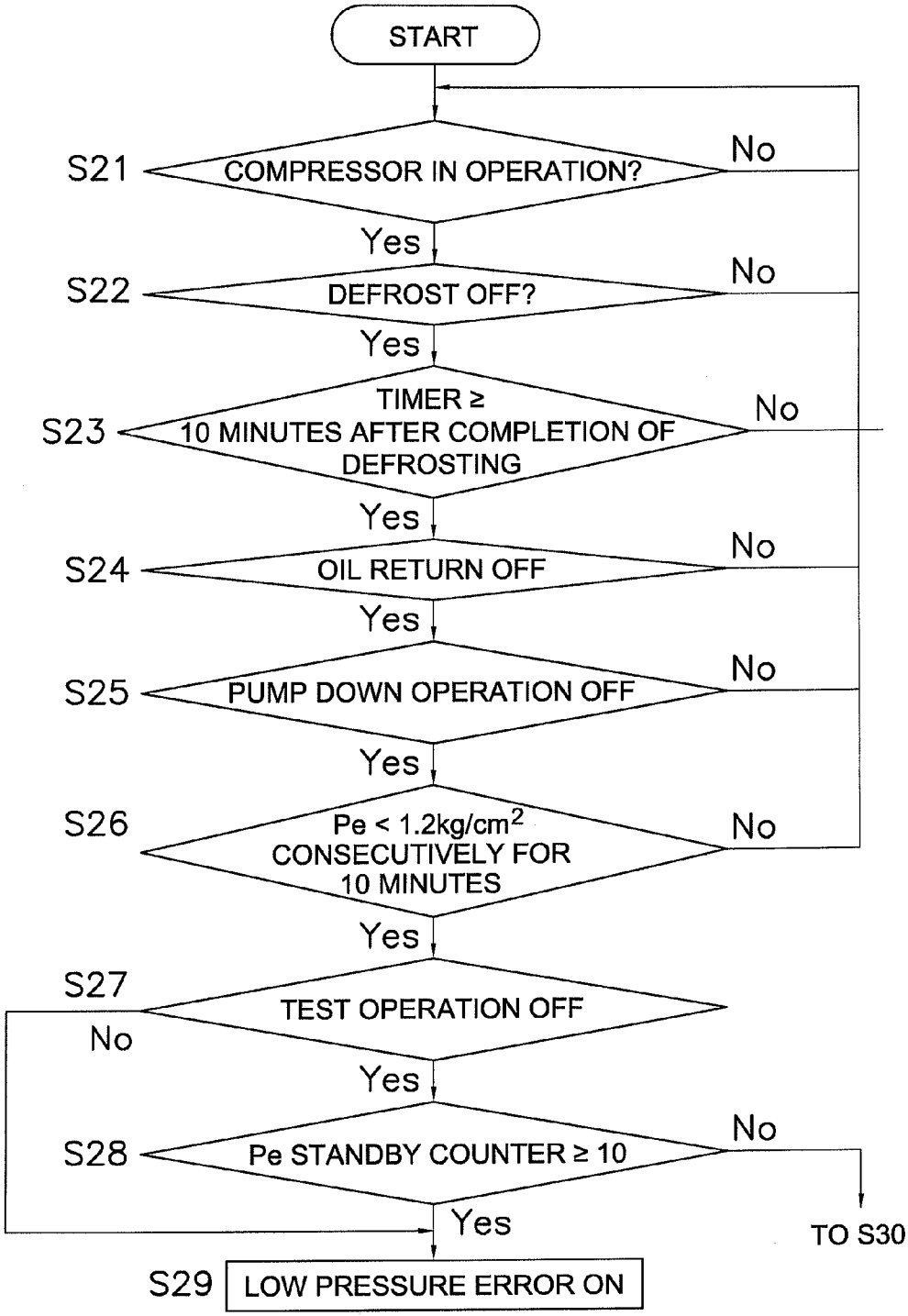
FIG. 4 is a flowchart of error confirmation control for a low pressure error.
Figure 5:
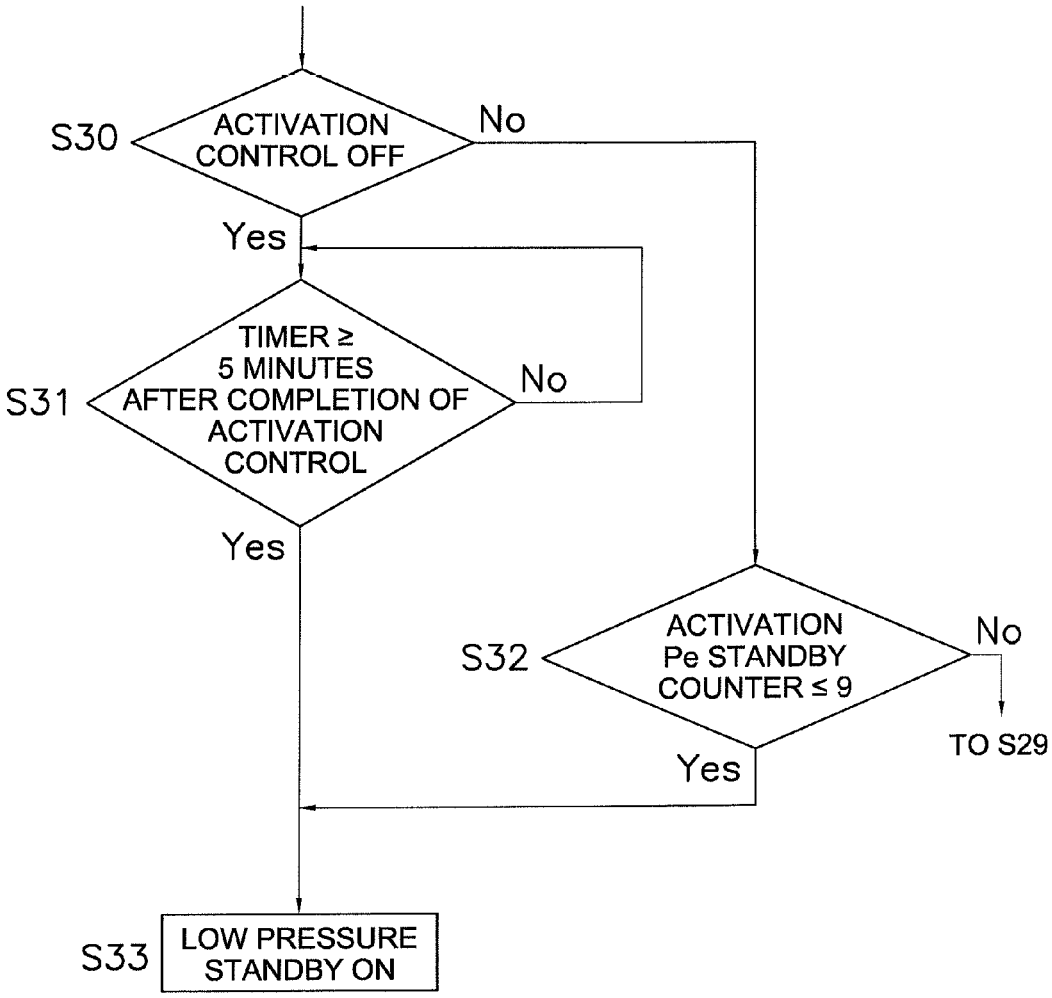
FIG. 5 is a continued flowchart of error confirmation control for a low pressure error in FIG. 4.

FIGS. 4 and 5 show a flowchart of error confirmation control for the low pressure error. As shown in FIG. 4, the microcomputer 5 judges in step S21 whether or not the compressor 111 is in operation. When it is judged that the compressor 111 is in operation in step S21, the flow proceeds to step S22 where it is judged whether or not the defrost mode is OFF ("defrost OFF"). Note that the "defrost OFF" means that the defrost control mode 920 is OFF.

When it is judged in step S22 that the defrost mode is OFF, the flow proceeds to step S23 where it is judged whether or not at least 10 minutes have elapsed after completion of defrosting. When it is judged in step S23 that at least 10 minutes have elapsed, the flow proceeds to step S24 where it is judged whether or not the oil return mode is OFF ("oil return OFF"). Note that the "oil return OFF" means that the oil return control mode 916 is OFF.

When it is judged in step S24 that the oil return mode is OFF, the flow proceeds to step S25 where it is judged whether or not the pump down operation mode is OFF ("pump down operation OFF"). Note that the "pump down operation OFF" means that the pump down control mode 917 is OFF.

When it is judged in step S25 that the pump down operation mode is OFF, the flow proceeds to step S26 where it is judged whether or not a state in which low pressure side pressure Pe is less than 1.2 kg/cm$^2$ is continued for a consecutive period of at least 10 minutes.

When it is judged in step S26 that the state is continued for a consecutive period of at least 10 minutes, the flow proceeds to step S27 where it is judged whether the test operation mode is OFF ("test operation OFF"). Note that the "test operation OFF" means that the test operation control mode 914 is OFF.

When it is judged in step S27 that the test operation mode is OFF, the flow proceeds to step S28 where it is judged whether or not a Pe standby counter has counted at least 10 times.

When it is judged in step S28 that it has counted at least 10 times, the flow proceeds to step S29 where it is confirmed that the error is the low pressure error, and a determination signal ON is output. Note that, also when it is judged in step S27 that the test operation is being performed, the flow proceeds to step S29 where it is confirmed that error is the low pressure error, and a determination signal ON is output.

The microcomputer 5 proceeds to step S30 (see FIG. 5) when it is judged in step S28 that the value of the Pe standby counter is less than 10. As shown in FIG. 5, in step S30, it is judged whether or not the activation control mode is OFF ("'activation control OFF"). Note that the "activation control OFF" means that the activation control mode 913 is OFF.

When it is judged in step S30 that the activation control mode is OFF, the flow proceeds to step S31 where it is judged whether or not at least 5 minutes have elapsed after completion of activation control. When it is judged in step S31 that at least five minutes have elapsed, the flow proceeds to step S33 where the compressor 111 is forcibly stopped and brought to the low pressure standby state.

When it is judged in step S30 that the activation control mode is not OFF, the flow proceeds to step S32 where it is judged whether or not the value of an activation Pe standby counter is equal to or smaller than 9. When it is judged in step S32 that the value is equal to or smaller than 9, the flow proceeds to step S33 where the compressor 111 is forcibly stopped and brought to the low pressure standby state. When it is judged in step S32 that the value is greater than 9, the flow proceeds to step S29 where it is confirmed that the error is the low pressure error, and a determination signal ON is output.

The above is the flow of error confirmation control for the low pressure error, and the microcomputer 5 obtains the operation mode being executed at the time of occurrence of the error and the operation information such as the details of the error and causes the memory 6 to store the information regarding the operation mode and the operation information when outputting of an error confirmation signal ON.

In error confirmation control for the low pressure error, the error is confirmed at the following three points. A first point to confirm the error is when it is judged to be "Yes" in all steps S21 to S28. At this time, the stationary control mode 915 is stored as the operation mode in the memory 6. It is identified that the low pressure error occurred during execution of the stationary control mode 915, and the error factor is determined to be an extreme gas shortage.

Note that, as can be seen from steps S22, S23, S24, and S25, a judgment of the low pressure error is not made during execution of the defrost control mode 920, the post-defrost control mode 921, the oil return control mode 916, and the pump down control mode 917. Therefore, when the air conditioner 1 is abnormally stopped and the details of an error are unclear, the operation mode at the time of occurrence of the error is read out from the memory 6, and thereby the error that would not occur in that operation mode can be specified and the error that would not occur is excluded from the subject of analysis of error factors. This simplifies the narrowing down of error factors.

A second point to confirm the error is when it is judged in step S27 that the test operation mode is not OFF (i.e., the test operation control mode 914 is being executed). In this embodiment, when the air conditioner 1 is abnormally stopped due to the low pressure error and if the operation mode at the time of occurrence of the error is the test operation control mode 914, it may be determined that the error factor is the fact that shut-off valves 118 and 119 being left closed.

A third point to confirm the error is when the value of the activation Pe counter is equal to or greater than 10 when the activation control mode is not OFF (i.e., the activation control mode 913 is being executed). In this embodiment, when the air conditioner 1 is abnormally stopped due to the low pressure error and if the operation mode at the time of occurrence of the error is the activation control mode 913, it may be determined that the error factor is the fact that the compressor 111 is frequently (10 times) brought to the low pressure standby state.

(HPS Defect and High Pressure Error)

Next, the process to narrow down error factors is described by taking a HPS defect and a high pressure error as examples. HPS is an abbreviation for a high pressure side pressure switch 71 (see FIG. 1) provided on the discharge side of the compressor 111. In this embodiment, in order to prevent damage of the equipment caused by an excessively high pressure rise, the air conditioner 1 is abnormally stopped as a result of a high pressure error when the HPS is actuated. Logically, the high pressure error is an error that occurs during operation of the compressor 111.

However, there is a case where the air conditioner 1 is abnormally stopped in the off-time control mode 911 where the compressor 111 is not running and also the HPS is being activated. It is logically impossible that a high pressure rise occurs while the compressor 111 is stopped, and the HPS defect is the only possible error factor. Consequently, in this embodiment, the memory 6 is caused to store the operation mode during activation of the HPS, and this simplifies determination of the HPS defect. In other words, when an error occurred when the operation mode was the off-time control mode 911 during activation of the HPS, the error factor is the HPS defect, and when an error occurred when the operation mode is the stationary control mode 915 during activation of the HPS, the error factor is the high pressure error.

(Error in the Smoothing Capacitor)

Next, the process to narrow down error factors is described by taking an error in a smoothing capacitor as an example. The smoothing capacitor is an electrolytic capacitor (not shown) connected in parallel to a direct current circuit that converts an alternating current output to a direct current output, and is disposed in the control device 4. In this embodiment, voltage between terminals of the smoothing capacitor is monitored in order to detect an error. There are two types of errors in the smoothing capacitor: one is where short circuit occurs between the terminals; and the other is where overvoltage occurs between the terminals. The short circuit between the terminals is an error in the circuit, and the overvoltage between the terminals of the smoothing capacitor is likely caused by a ground fault in the compressor 111.

Thus, in this embodiment, the short circuit between the terminals of the smoothing capacitor is detected before the compressor 111 is activated, and the overvoltage of the smoothing capacitor is detected when the operation mode is the activation control mode 913 where the compressor 111 is activated. The operation mode at the time of occurrence of an error is stored in the memory 6. In other word, when the error in the smoothing capacitor occurred before the compressor 111 is activated, it may be determined that the error factor is the short circuit between the terminals; when the error occurred in the activation control mode 913, it may be determined that the error factor is the overvoltage between the terminals caused by a ground fault in the compressor 111.

(LPS Defect)

Next, the process to narrow down error factors is described by taking the LPS defect as an example. LPS is an abbreviation for a low pressure side pressure switch 72 (see FIG. 1) provided on the suction side of the compressor 111. There are two types of phenomena in the LPS defect. One is an open contact point defect that occurs when the internal contact point of the LPS is in the open state. The other one is a closed contact point defect that occurs when the internal point of the LPS is in the closed state. Consequently, the LPS defect by itself does not specify whether it is the open contact point defect or the closed contact point defect.

Thus, experiments were performed to confirm that the open contact point defect occurs at the time of completion of the pre-activation pressure equalization control mode 912 and that the closed contact point defect occurs during compressor operation (stationary control mode 915), and the configuration was made such that the operation mode at the time of occurrence of the LPS defect is stored in the memory 6. In other words, when the operation mode at the time of occurrence of the LPS defect is the pre-activation pressure equalization control mode 912, the error factor is the open contact point defect. Additionally, when the operation mode at the time of occurrence of the LPS defect is the stationary control mode 915, the error factor is the closed contact point defect.

<Characteristics>

(1)

The control device 4 includes the microcomputer 5 and the memory 6. The microcomputer 5 executes the inspection operation mode 801 in which the air conditioner 1 is operated in the inspection process in a manufacturing site, and the normal operation mode 901 in which the air conditioner 1 is operated at an installation site. When the operation state of the air conditioner 1 fails to satisfy predetermined conditions, the microcomputer 5 confirms that there is an error, and abnormally stops the air conditioner 1. When abnormally stopping the air conditioner 1, the microcomputer 5 causes the memory 6 to store the specific information obtained during a period until abnormal stoppage of the air conditioner 1 and the operation mode being executed at the time of occurrence of the error in the air conditioner 1.

In the control device 4, the backgrounds at the time of occurrence of an error, i.e., whether the error occurred during inspection or during normal operation, and the like, become clear, and this simplifies the narrowing down of error factors.

(2)

In the control device 4, the normal operation mode 901 includes the plurality of control modes 911 to 921. When abnormally stopping the air conditioner 1, the microcomputer 5 causes the memory 6 to store any one of the control modes 911 to 921 that was being executed at the time of occurrence of an error in the air conditioner 1. Therefore, which one of the control modes 911 to 921 was being executed is identified and thereby an error that can occur only in the identified control mode among the control modes 911 to 921 is specified. Alternatively, an error that would not occur in the identified control mode among the control modes 911 to 921 is excluded from the subject of analysis of error factors. This simplifies the narrowing down of error factors.

For example, when an error occurs during activation of the HPS in the off-time control mode 911, it can be determined that the error factor is the HPS defect. Additionally, when the LPS defect occurs in the pre-activation pressure equalization control mode 912, it can be determined that the error factor is the open contact point defect. Further, when the voltage error occurs between the terminals of the electrolytic capacitor in the activation control mode 913, it can be determined that the error factor is ground fault. Further, when the low pressure error occurs in the test operation control mode 914, it can be determined that the error factor is the fact that the shut-off valves 118 and 119 being left closed. Still further, when the low pressure error occurs in the stationary control mode 915, it can be determined that the error factor is extreme gas shortage.

Still further, the low pressure error can be excluded from the subject of analysis of error factors when the air conditioner 1 is abnormally stopped in any of the following control modes: oil return control mode 916, pump down control mode 917, defrost control mode 920, and post-defrost control mode 921.

(3)

In the control device 4, the microcomputer 5 causes the in-and-out transmission between the air conditioner outdoor unit 2 and the air conditioner indoor unit 3 of the air conditioner 1, and determines which one between the air conditioner indoor unit 3 and the inspection equipment is connected to the in-and-out transmission line 50 based on the source information sent from the air conditioner indoor unit 3 side. When the inspection equipment is connected, the microcomputer 5 sets the operation mode 701 to the inspection operation mode 801, whereas when the air conditioner indoor unit 3 is connected, the microcomputer 5 sets the operation mode 701 to the normal operation mode 901. In the case of an error in the inspection operation mode 801, the error can be recreated in the inspection process and this simplifies the narrowing down of error factors.

INDUSTRIAL APPLICABILITY

As described above, the present invention simplifies the narrowing down of error factors at the time of occurrence of an error in an air conditioner, and thus is useful to an air conditioner control device.

What is claimed is:

1. An air conditioner control device, comprising:

a microcomputer configured to execute an inspection operation mode in which an air conditioner is operated in an inspection process in a manufacturing site, and a normal operation mode in which the air conditioner is operated at an installation site; and a storage element configured to store predetermined information in response to a command from the microcomputer, the microcomputer being configured to confirm that there is an error and to abnormally stop the air conditioner when an operation state of the air conditioner fails to satisfy predetermined conditions, the microcomputer being further configured to cause the storage element to store predetermined operation information obtained during a period until abnormal stoppage of the air conditioner when the air conditioner is abnormally stopped, and the microcomputer being further configured to cause the storage element to store the operation mode being executed at the time of occurrence of the error in the air conditioner.

2. The air conditioner control device according to claim 1, wherein the normal operation mode includes a plurality of control modes, and the microcomputer is configured to cause the storage element to store the control mode being executed at the time of occurrence of the error in the air conditioner when the air conditioner is abnormally stopped.

3. The air conditioner control device according to claim 2, wherein the air conditioner includes a refrigerant circuit having a compressor, and the plurality of control modes include an off-time control mode in which the air conditioner is controlled while the compressor is stopped.

4. The air conditioner control device according to claim 2, wherein the air conditioner includes a refrigerant circuit having a compressor, and the plurality of control modes include a pre-activation pressure equalization control mode in which a difference in pressure between a high pressure side and a low pressure side of the refrigerant circuit is eliminated before the compressor is activated.

5. The air conditioner control device according to claim 2, wherein the air conditioner includes a refrigerant circuit having a compressor, and the plurality of control modes include an activation control mode in which the compressor is activated.

6. The air conditioner control device according to claim 2, wherein the plurality of control modes include a test operation control mode in which test operation after installation of the air conditioner is performed.

7. The air conditioner control device according to claim 2, wherein the air conditioner includes a refrigerant circuit having a compressor, and the plurality of control modes include a stationary control mode in which stationary operation of the air conditioner is performed after the compressor is activated.

8. The air conditioner control device according to claim 2, wherein the air conditioner includes a refrigerant circuit having a compressor, and the plurality of control modes include an oil return control mode in which refrigerating machine oil accumulated in the refrigerant circuit is forcibly returned to the compressor.

9. The air conditioner control device according to claim 2, wherein the air conditioner includes a refrigerant circuit having a compressor, and the plurality of control modes include a pump down control mode in which liquid refrigerant in the refrigerant circuit is accumulated in a predetermined container when the operation of the air conditioner is stopped.

10. The air conditioner control device according to claim 2, wherein the plurality of control modes include a defrost control mode in which defrosting is performed when frost is formed during heating operation of the air conditioner.

11. The air conditioner control device according to claim 2, wherein the plurality of control modes include a post-defrost control mode in which control after completion of defrosting is performed during heating operation of the air conditioner.

12. The air conditioner control device according to claim 1, wherein the microcomputer is further configured to cause a signal to be transmitted and received between an outdoor side of the air conditioner and an indoor side of the air conditioner, and the microcomputer is further configured to switch switches between the inspection operation mode and the normal operation mode based on source information being sent from the indoor side, and the source information indicates what equipment is connected on the indoor side.

* * * * *